US006952879B2

(12) United States Patent
Okabe

(10) Patent No.: US 6,952,879 B2
(45) Date of Patent: Oct. 11, 2005

(54) INNER CUTTER UNIT FOR AN ELECTRIC ROTARY SHAVER

(75) Inventor: Masaki Okabe, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 10/418,640

(22) Filed: Apr. 18, 2003

(65) Prior Publication Data

US 2003/0196329 A1 Oct. 23, 2003

(30) Foreign Application Priority Data

Apr. 18, 2002 (JP) ..... 2002-116521
Apr. 10, 2003 (JP) ..... 2003-106941

(51) Int. Cl.[7] ..... B26B 19/14
(52) U.S. Cl. ..... 30/346.51; 30/43.6
(58) Field of Search ..... 30/346.51, 43.6, 30/43.5, 265, 346.54

(56) References Cited

U.S. PATENT DOCUMENTS 2,616,168 A * 11/1952 Dankers ..... 30/43.6
3,261,091 A 7/1966 Van De Driest

FOREIGN PATENT DOCUMENTS

EP 0 566 234 10/1993
EP 0 566 292 10/1993

* cited by examiner

*Primary Examiner*—Douglas D Watts
(74) *Attorney, Agent, or Firm*—Koda & Androlia

(57) ABSTRACT

An inner cutter unit, which is used in an electric rotary shaver, including an inner cutter base, which is connected to the axle of the motor of the shaver and rotated, and an inner cutter body, which is disposed on the inner cutter base. The inner cutter body is formed with an inside circumferential cutter body having a plurality of cutter blades and an outside circumferential cutter body also having a plurality cutter blades; and the inner and outside circumferential cutter bodies in an upright posture are obtained by way of cutting out annular metal walls that are concentrically formed in an upright posture with a bridging section in between.

3 Claims, 5 Drawing Sheets

INNER CUTTER UNIT FOR AN ELECTRIC ROTARY SHAVER

BACKGROUND OF THE INVENTION

1. Field of the Invention

The present invention relates to an inner cutter unit for an electric rotary shaver and more particularly to an inner cutter unit in which an inner cutter body is integrally provided on an inner cutter base that is rotated by a motor of the shaver.

2. Prior Art

In an electric rotary shaver, a shaver head frame is detachably disposed on the upper portion of the main body case of the shaver. The shaver head frame includes an outer cutter unit and an inner cutter unit; and the main body case is, in addition to other components, equipped with a driving source (motor), a driving mechanism, a power supply and an operating switch.

The rotary shaft (or the axle) of the motor extends from the main body case into the shaver head frame and engages with the inner cutter unit. Some shavers include only one inner cutter unit, and other shavers involve a plurality of (three, for instance) inner cutter units.

One example of the inner cutter unit of an electric rotary shaver is shown in FIGS. 6 and 7.

The external shape of the inside circumferential cutter blades 55 and outside circumferential cutter blades 56 is formed by punching out a metal plate which is, for instance, a stainless steel plate; and hole working is performed in the base section 51 so as to form an engagement hole 54 therein that engages with the shaft portion 53 of an inner cutter base 52. Circumferential edge portion of the base section 51 is subjected to bending, so that a plurality of inner cutter bodies 57, in which the inside circumferential cutter blades 55 and the outside circumferential cutter blades 56 form pairs, are formed in an upright posture with respect to the base section 51. The inner cutter bodies 57 are bent so as to be inclined in the direction of rotation (the clockwise direction in FIG. 6). The shaft portion 53 of the inner cutter base 52 is brought into an engagement with the engagement hole 54 of the base section 51 that has thereon the inner cutter bodies 57, thus forming an integral inner cutter unit 58. The inner cutter unit 58 is rotationally driven with a bearing portion (not shown) formed on the undersurface side of the shaft portion 53 being engaged with an axle of the motor (not shown) of the shaver.

Since the inner cutter bodies 57 are obtained by punching and bending a metal plate by press working, a space such as a bending margin, etc., that is required for bending is necessary in order to form the inner cutter bodies 57 that have a specified area within a fixed circumference. Accordingly, there are limits to the number of inside circumferential cutter blades 55 and outside circumferential cutter blades 56; and as a result, there are also limits to how far the efficiency can be improved when hair is cut (or shaved) using such an electric rotary shaver.

Furthermore, since the tip end (cutter blade surfaces 59) of the inside circumferential cutter blades 55 and outside circumferential cutter blades 56 generate dimensional differences t in the radial direction, as seen from FIG. 8, that is caused by shear droop. As a result, the amount of area of one tip end (cutter blade surface 59), which makes a sliding contact with outer cutter, would become different from that of another tip end (cutter blade surface 59), causing a friction increase and an efficiency drop.

Furthermore, the inner cutter bodies 57 shown in FIG. 7, in which the inside circumferential cutter blades 55 and outside circumferential cutter blades 56 are formed continuously into an integral unit, are formed so as to rise from the base section 51 by bending and then bent so as to incline in the direction of rotation of the inner cutter unit 58. In some cases, therefore, the rotational trajectory drawn by the cutter blade surface 59 and shown in FIG. 9 becomes wider than the width dimension thereof. In other words, in some cases, the cutter blade surface 59 draws (during the rotation) a trajectory regulated by the inside circumferential edge portion 59*a* and the outside circumferential edge portion 59*b*; as a result, it becomes difficult to obtain precision in the rotational radius, and the element that draws the rotational trajectory needs to be set at larger values.

SUMMARY OF THE INVENTION

It is, therefore, an object of the present invention to provide an inner cutter unit for an electric rotary shaver that solves the above-described problems in the prior art shavers.

It is another object of the present invention to provide an inner cutter unit for an electric rotary shaver which makes it possible to form a desired number of inner and outside circumferential cutter blades, to easily obtain precision of the cutter blade surface in the radius direction, and to allow the cutter blades to draw constant rotational trajectories.

The above object is accomplished by a unique structure of the present invention for an inner cutter unit used in an electric rotary shaver, in which the inner cutter unit includes an inner cutter base, which is connected to a rotary shaft of the shaver and rotated, and an inner cutter body, which is integrally provided on the inner cutter base; and in the present invention, the inner cutter body is comprised of:

- an inside circumferential cutter body having a plurality of inside circumferential cutter blades formed in the circumferential direction, and
- an outside circumferential cutter body having a plurality of outside circumferential cutter blades formed in the circumferential direction; and
- the inside circumferential cutter body and the outside circumferential cutter body are integrally formed in an upright posture by way of cutting out annular metal walls that are concentrically formed in an upright posture with a bridging section in between.

In this structure, the inner cutter body is assembled in an integral unit into the inner cutter base by way of securing engagement pins protruding from the inner cutter base in engagement holes formed in the bridging section of the inner cutter body.

Furthermore, the inside circumferential cutter blades and the outside circumferential cutter blades are formed in an upright posture so that such cutter blades are inclined, with respect to the vertical direction, in the direction in which the cutter blades are rotated.

In the above structure, the thickness of the cutter blade surfaces of the inside and outside circumferential cutter blades in the direction of rotation is set to be smaller than the thickness of the base portions of the cutter blades.

DETAILED DESCRIPTION OF THE INVENTION

Figure 1:
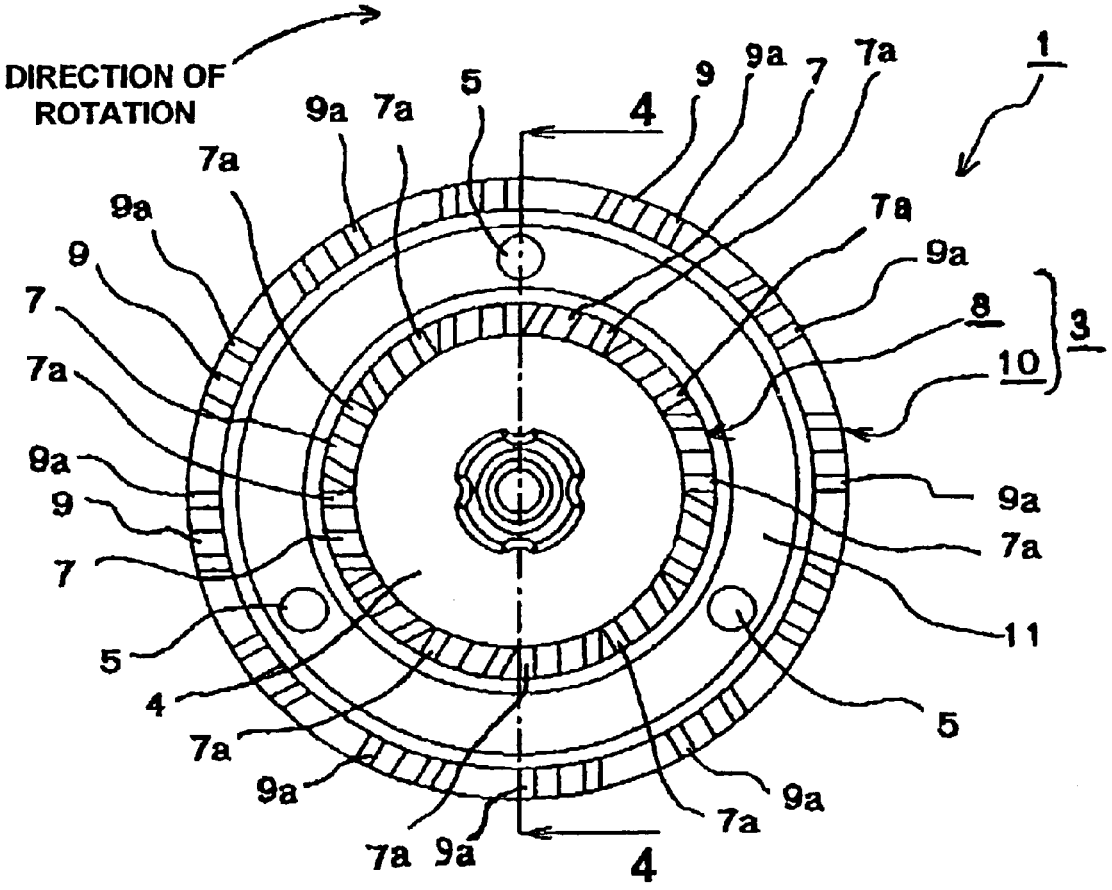
FIG. 1 is a top view of the inner cutter unit according to the present invention.

Preferred embodiments of the present invention will be described in detail below with reference to the accompanying drawings.

An electric rotary shaver in which the inner cutter unit of the present invention is used is generally structured so that a shaver head frame which has an outer cutter unit and an inner cutter unit is disposed in the upper portion of a main body case of the shaver which includes, in addition to other components, a driving source and a driving mechanism. The rotary shaft (axle) of a motor installed in the main body case extends from the main body to the shaver head frame, and the inner cutter unit is connected to the axle of the motor. The inner cutter unit is rotated by the rotational driving force of the axle of the motor, and hair (whiskers) is cut by a cooperation of the inner cutter unit and the outer cutter unit.

In FIGS. 1 through 5, the inner cutter unit 1 is comprised of a circular-shaped inner cutter base 2 and an inner cutter body 3. The inner cutter base 2 is connected to the rotary shaft (axle of a motor) that extends from the main body case (not shown) of a shaver, and the inner cutter base 2 is rotationally driven by the motor. The inner cutter body 3 in a circular shape is provided on the inner cutter base 2 integrally.

The inner cutter base 2 includes a supporting surface 4, and the inner cutter body 3 is provided on this supporting surface 4.

Figure 4:
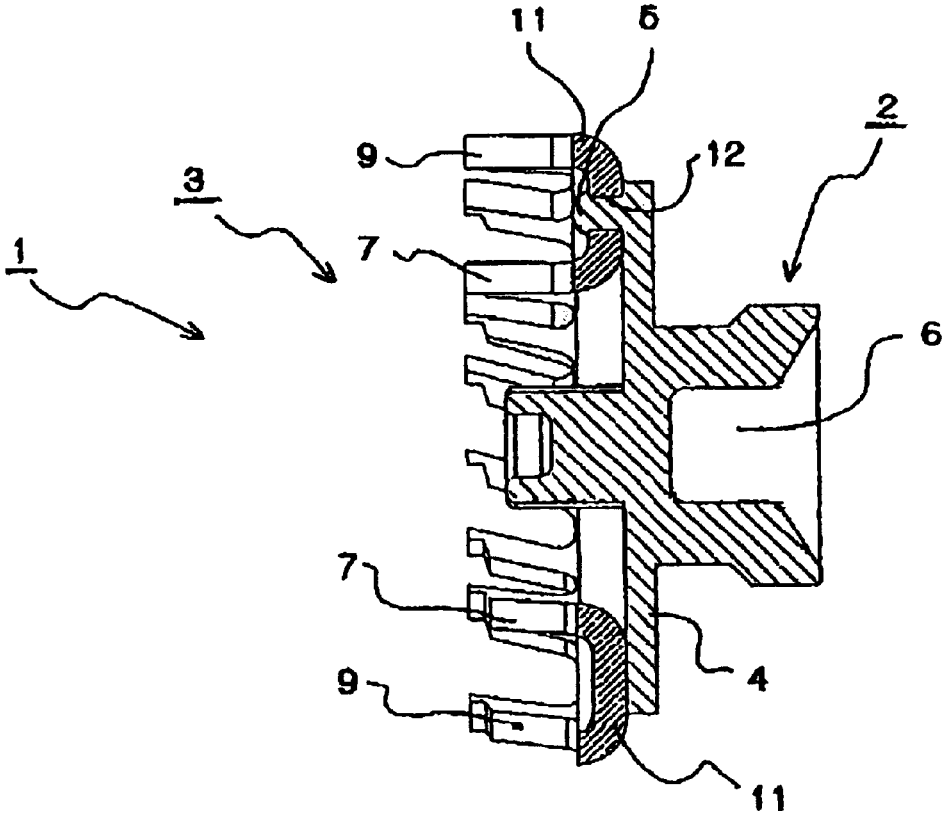
FIG. 4 is a sectional view taken along the line 4—4 in FIG. 1.

The inner cutter base 2 is as seen from FIG. 4 provided with engagement pins 5 which are formed so as to protrude from the supporting surface 4 at a plurality of locations in the circumferential direction. As best seen from FIGS. 3 and 4, the inner cutter base 2 is provided, in its lower part, with an engagement hole 6 which is closed at one end (or top end). The engagement hole 6 engages with the axle of the motor (not shown) of the shaver.

Furthermore, on the inner cutter body 3, an inside circumferential cutter body 8 and an outside circumferential cutter body 10 are formed with a bridging section 11, which is disposed in the direction of diameter of the inner cutter body 3 (see FIG. 1), in between. The inner and outside circumferential cutter bodies 8 and 10 take an upright posture in a concentric configuration in the axial direction of the inner cutter body 3.

The inside circumferential cutter body 8 is formed with a plurality of inside circumferential cutter blades 7 so that the inside circumferential cutter blades 7 are arranged in the circumferential direction. Likewise, the outside circumferential cutter body 10 is formed with a plurality of outside circumferential cutter blades 9 so that the outside circumferential cutter blades 9 are arranged in the circumferential direction.

The inside circumferential cutter body 8 and the outside circumferential cutter body 10 are obtained in an integral unit by way of cutting out annular (ring-shaped) metal walls (e.g., metal walls with a U-shaped or C-shaped cross section) that are disposed in an upright posture in a concentric configuration with the bridging section 11 in between (see FIG. 4). The annular metal walls used for the inner cutter body 3 are stainless steel plates, aluminum plates, etc. Since the inner cutter body 3 is thus formed by cutting out annular metal walls by way of cutting, etc., any desired number of cutter blades can be formed at an arbitrary pitch. Accordingly, the efficiency that is obtained when hair is cut by the electric rotary shaver is improved.

Furthermore, the inner cutter body 3 is integrally formed into a single body with the inner cutter base 2. This is done by inserting the engagement pins 5 that protrude from the supporting surface 4 of the inner cutter base 2 into the engagement holes 12 formed in the bridging section 11 of the inner cutter body 3 and then crimping the head portions of the engagement pins 5 (see FIG. 4).

Figure 2:
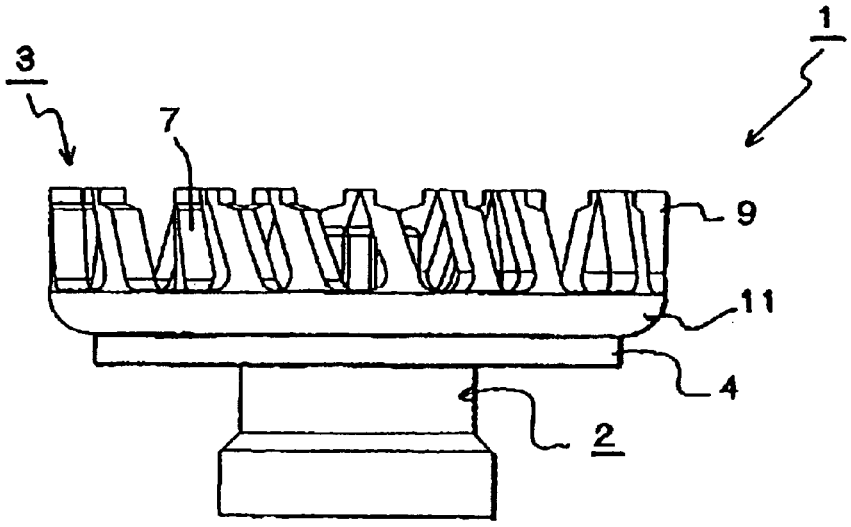
FIG. 2 is a front view thereof.
Figure 3:
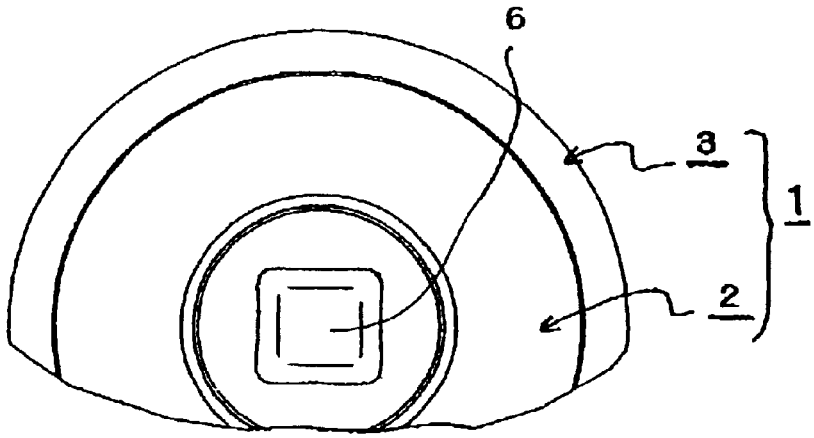
FIG. 3 is a partial bottom view thereof.

Moreover, as best seen from FIG. 2 in conjunction with FIG. 1, the inside circumferential cutter blades 7 and the outside circumferential cutter blades 9 are formed in an upright posture, and these cutter blades are inclined with respect to the vertical direction in the direction of rotation of the cutter blades 7 and 9 (which is a clockwise direction in FIG. 1).

Figure 5:
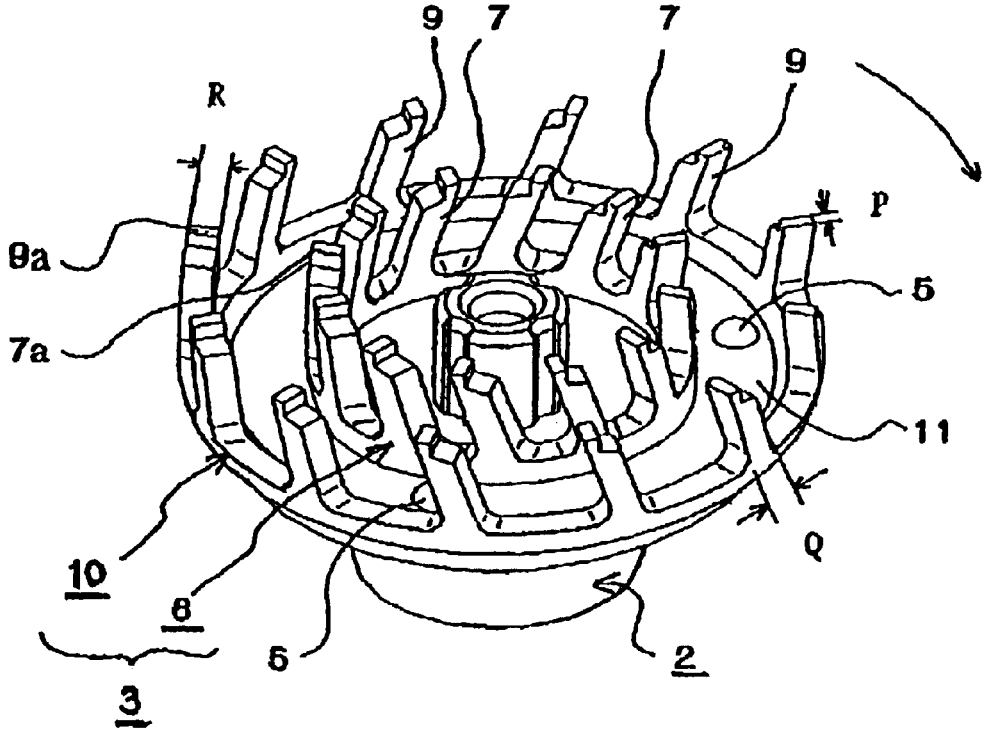
FIG. 5 is a perspective view of the inner cutter unit of the present invention.
Figure 6:
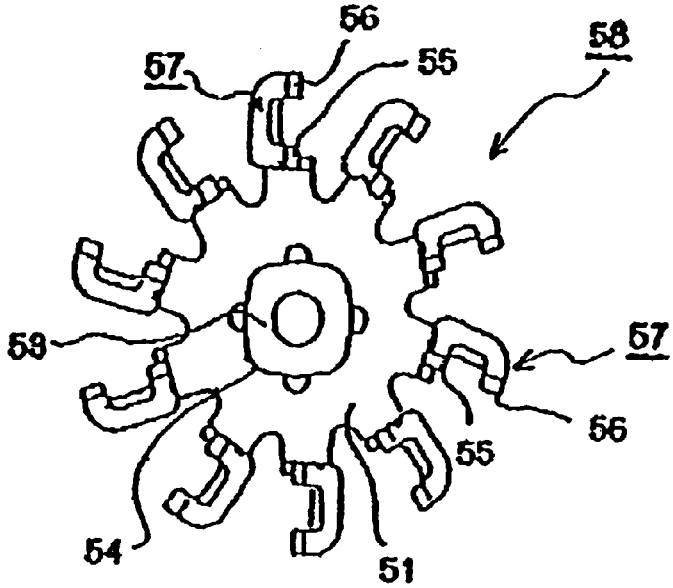
FIG. 6 PRIOR ART
FIG. 6 is a top view of a conventional inner cutter unit.
Figure 7:
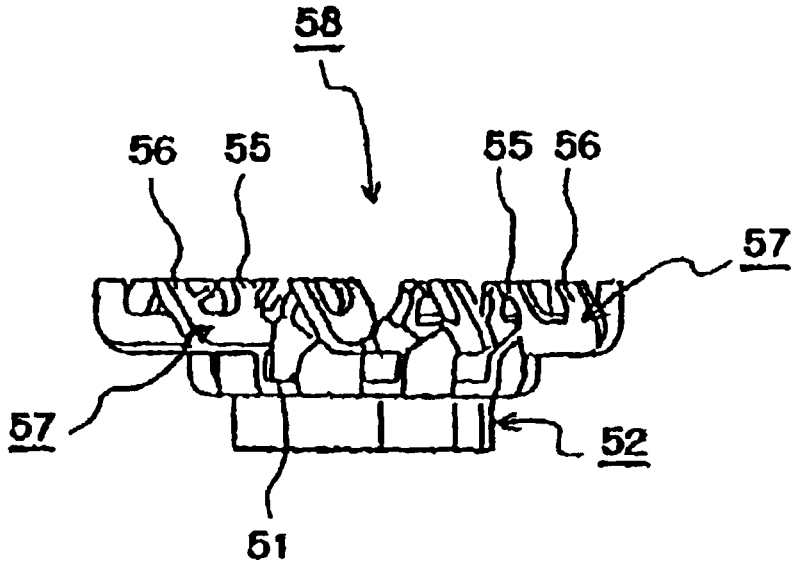
FIG. 7 PRIOR ART
FIG. 7 is a front view thereof.
Figure 8:
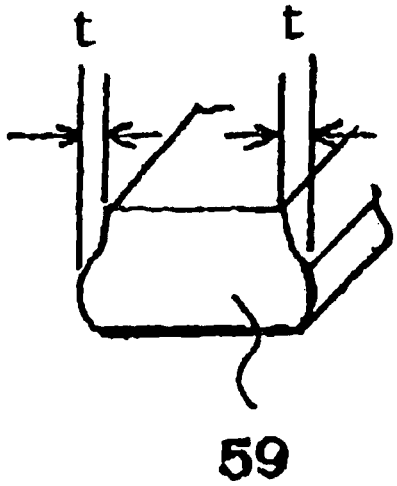
FIG. 8 PRIOR ART
FIG. 8 is an explanatory diagram of the tip end (cutter blade surface) of an inner cutter blade.
Figure 9:
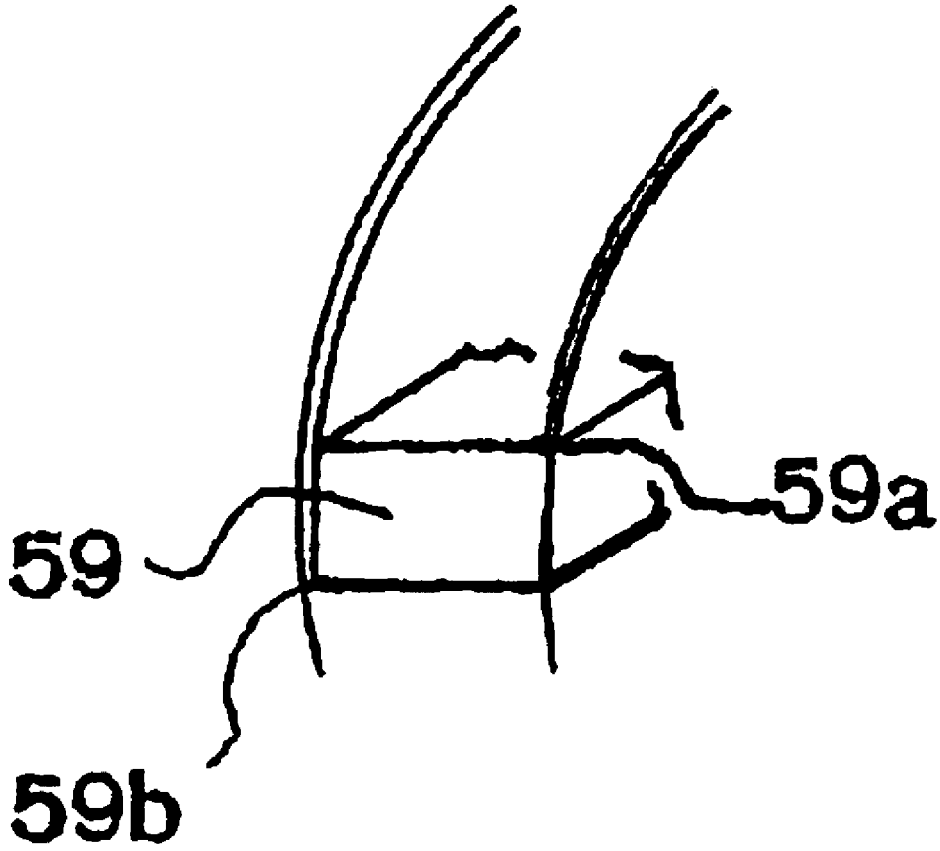
FIG. 9 PRIOR ART
FIG. 9 is an explanatory diagram of a part of the rotational trajectories of an inner cutter blade.

Furthermore, as best seen from FIG. 5, the thickness (cutter blade thickness) P of the cutter blade (cutter blade surface) 7*a* and 9*a* of the inside and outside circumferential cutter blades 7 and 9 in the direction of rotation is set so that the thickness P is smaller than the thickness Q of the base portions of the cutter blades 7 and 9. As a result, the area in which a sliding contact between the cutter blade surfaces 7*a* and 9*a* and the outer cutter (not show) is made can be reduced; and thus the frictional force can be reduced, and an improved rotational efficiency can be obtained.

Furthermore, as described above, the inside circumferential cutter blades 7 and outside circumferential cutter blades 9 are obtained by cutting out annular (ring-shaped) metal walls. Accordingly, the width (cutter blade width) R on the leading (or front) edge of the cutter blade surfaces 7*a* and 9*a* and the width R on the trailing (or rear) edge of the cutter blade surfaces 7*a* and 9*a*, both with respect to the direction of rotation, are formed to be equal; and thus, circular trajectories formed by both ends of the leading (front) edge and by both ends of the trailing (rear) edge of each one of the cutter blade surfaces 7*a* and 9*a* of the inside and outside cutter blades 7 and 9 draw concentric circles, keeping constant distance in between (see FIG. 5). Thus, the dimensional precision of the inner and outside circumferential cutter blades in the direction of radius is easily obtained, useless spaces can be eliminated, and the inner cutter unit 1 can be formed compact.

Preferred embodiments of the present invention are described above, but the present invention is not limited to those embodiments. In the above, a dual track inner cutter unit that comprises the inside circumferential cutter body 8 and the outside circumferential cutter body 10 which are disposed concentrically is described. However, it is also possible to form quadruple track cutters by way of cutting out four annular metal walls of a concentric configuration, thus forming four circumferential cutter bodies that have cutter blades thereon.

Furthermore, it goes without saying that numerous modifications can be made without departing from the spirit of the invention; and the present invention is applicable to not only a shaver in which a single set of inner cutter unit and outer cutter unit is installed and but also a shaver in which a plurality of sets of inner cutter units and outer cutter units are installed.

As seen from the above, in the inner cutter unit for an electric rotary shaver of the present invention, the inside circumferential cutter body and the outside circumferential cutter body that make the inner cutter body are integrally formed in an upright posture by cutting out annular metal walls that are formed in an upright posture with a bridging section in between and in a concentric configuration. Accordingly, the number of cutter blades formed on such circumferential cutter bodies can be increased or decreased at an arbitrary pitch, and the efficiency for cutting or shaving is improved.

Furthermore, in the present invention, the inside circumferential cutter blades and the outside circumferential cutter blades are formed by cutting out annular metal walls. Accordingly, the width of the leading (front) edge and the width of the trailing (rear) edge of the cutter blade surfaces with respect to the direction of rotation are equal; and circular trajectories drawn by both ends of the leading (front) edge and by both ends of the trailing (rear) edge of each one of the cutter blade surfaces of the inside and outside cutter blades draw concentric circles, keeping a constant distance in between. Thus, the dimensional precision of the inner and outside circumferential cutter blades in the direction of radius is easily obtained, useless spaces can be eliminated, and the inner cutter body can be formed compact.

Furthermore, the thickness of the cutter blade surfaces of the inside circumferential cutter blades and outside circumferential cutter blades in the direction of rotation is set to be smaller than the thickness of the base portions of the cutter blades. Accordingly, a sliding contact area of the cutter blades is reduced, and the frictional force and sliding noise of the cutter blades is reduced, thus making it possible to improve the rotational efficiency.

What is claimed is:

1. An inner cutter unit for an electric rotary shaver, said inner cutter unit comprising:

an inner cutter base which is connected to a rotary shaft of said shaver so as to be rotationally driven, and an inner cutter body integrally provided on said inner cutter base; wherein said inner cutter body comprises:

an inside circumferential cutter body on which a plurality of inside circumferential cutter blades are formed in a circumferential direction thereof, and an outside circumferential cutter body on which a plurality of outside circumferential cutter blades are formed in a circumferential direction thereof, and wherein said outer blades of said inside circumferential cutter body and said outside circumferential cutter body are formed in an upright posture by way of cutting out upright annular metal walls that are coaxially formed with a bridging section in between;

said inner cutter body is provided integrally on said inner cutter base with engagement pins protruding from said inner cutter base being engaged with engagement holes formed in said bridging section of said inner cutter body; and said inside circumferential cutter blades and said outside circumferential cutter blades are formed in an upright posture and inclined, with respect to a vertical direction, in a direction of rotation of said cutter blades.

2. An inner cutter unit for an electric rotary shaver, said inner cutter unit comprising:

an inner cutter base which is connected to a rotary shaft of said shaver so as to be rotationally driven, and an inner cutter body integrally provided on said inner cutter base; wherein said inner cutter body comprises:

an inside circumferential cutter body on which a plurality of inside circumferential cutter blades are formed in a circumferential direction thereof, and an outside circumferential cutter body on which a plurality of outside circumferential cutter blades are formed in a circumferential direction thereof, and wherein said cutter blades of said inside circumferential outer body and said outside circumferential cutter body are formed in an upright posture by way of cutting out upright armular metal walls that are coaxially formed with a bridging section in between;

said inner cutter body is provided integrally on said inner cutter base with engagement pins protruding from said inner cutter base being engaged with engagement holes formed in said bridging section of said inner cutter body; and a thickness of cutter blade surfaces of said inside circumferential cutter blades and said outside circumferential cutter blades in a direction of rotation of said outer blades is set to be smaller than thickness of base portions of said cutter blades.

3. The inner cutter unit for an electric rotary shaver according to claim 1, wherein a thickness of cutter blade surfaces of said inside circumferential cutter blades and said outside circumferential cutter blades in a direction of rotation of said cutter blades is set to be smaller than thickness of base portion of said cutter blades.

* * * * *